United States Patent [19]

Coursaut

[11] 3,930,588

[45] Jan. 6, 1976

[54] BOTTLE CAP

[75] Inventor: Henri Coursaut, Mercurey, France

[73] Assignee: Le Bouchage Mecanique, Paris, France

[22] Filed: Feb. 11, 1974

[21] Appl. No.: 441,149

[30] Foreign Application Priority Data

Feb. 13, 1973 France ..... 73.04964

[52] U.S. Cl. ..... 215/230; 215/252; 215/253

[51] Int. Cl.[2] ..... B65D 41/34

[58] Field of Search ..... 215/203, 230, 251, 252, 215/256; 220/276

[56] References Cited

UNITED STATES PATENTS

| | | | |
|---|---|---|---|
| 1,875,431 | 9/1932 | Fabrice | 215/251 |
| 2,415,609 | 2/1947 | Sebell | 215/256 |
| 2,888,159 | 5/1959 | Fields | 215/230 |
| 3,685,677 | 8/1972 | Westfall | 215/252 |

FOREIGN PATENTS OR APPLICATIONS

| | | | |
|---|---|---|---|
| 969,349 | 5/1958 | Germany | 215/256 |

*Primary Examiner*—Donald F. Norton
*Attorney, Agent, or Firm*—Pennie & Edmonds

[57] ABSTRACT

A bottle cap comprises a cap member the lower end of whose skirt forms a ring detachable from the remainder of that member along a line of perforations, and a cylindrical skirt member which extends inside of and is fastened to that ring.

7 Claims, 6 Drawing Figures

BOTTLE CAP

The present invention pertains to screw-type caps for bottles. It has heretofore been proposed to provide screw-type bottle caps which cannot be opened and then reclosed without the fact of their opening being apparent. Such caps, hereinafter for convenience sometimes called "security caps," have included a long skirt to be crimped against the bottle neck in the bottle capping operation, the upper portion of the skirt being moreover plastically deformed in that operation against a male thread on the bottle neck to form a mating female thread in the cap for reclosure purposes, the skirt additionally having, below the position of this thread but above the shoulder of the bottle neck against and beneath which the skirt is crimped, two parallel circular scorings or rows of perforations defining a ring or strip which can be torn off by hand or which is intended to detach itself from the cap and bottle when the bottle is first opened by unscrewing the cap therefrom. The lower part of the skirt below the ring remains affixed to the bottle neck. Removal of this ring or tear strip has the advantage of making obvious the fact that the bottle has been opened.

If moreover in manufacture of the cap or in the application thereof to the bottle there has been affixed to or embossed into the skirt a design or inscription straddling the tear strip, the portion of the design borne by the tear strip will disappear when the latter is removed. This device may be employed to insure destruction of tax stamps, for example, in the case of alcoholic beverages subjected to taxation.

Bottle caps of this type are however subject to various shortcomings. If the tear strip is made easy to remove by inclusion therein of vertical incisions which divide it into several parts when the strip is pulled off, it sometimes occurs that not all of these parts detach themselves from the remainder of the cap upon first opening of the bottle. Moreover after the tear strip has been removed, when the bottle is reclosed there will be apparent a portion of the glass thereof between the cap as reapplied and the remainder of the skirt adhering to the bottle neck — an unsightly result.

In addition, a tear strip defined by two parallel scorings in the skirt of a screw-type cap of the known type above described must fit on the bottle below the male thread and yet above the shoulder against and under which the skirt is crimped when the bottle is initially capped. This means that caps having a tear strip defined by two such parallel scorings can only be used on bottles having a relatively large height between the lower end of the male thread and the shoulder. The bottle neck may possess a thickened portion, for convenience here called a thread annulus, which has the male thread formed in the upper portion thereof and which includes a smooth lower portion terminating at the crimping shoulder. Caps of the known type hereinabove described are thus suitable only for use on bottles having a thread annulus including such a smooth lower portion of adequate height.

It is an object of the present invention to overcome these shortcomings and to provide a screw-type reclosable security bottle cap having a tear strip or ring and a long skirt, the construction being such that removal of the tear strip entails destruction of a readily visible portion of the cap and of a design or tax stamp thereon, such cap being moreover applicable to bottles having a wide range of heights for the neck thereof below the male thread and yet above the crimping shoulder, i.e. a wide range of heights for the smooth lower portion of the thread annulus thereof.

The cap of the invention comprises two parts. The first of these, hereinafter called the cap member, includes a crown and a skirt integral therewith, the lower portion of this skirt forming a frangible ring or loop separated from the upper portion of the skirt by a row of perforations. The second part, hereinafter called the skirt member, may be of cylindrical shape with its upper end engaging telescopically with the said ring and being affixed thereto in any suitable way.

The connection together of the two members is desirably so achieved as to result in the spontaneous falling away of the ring when the bottle is first opened.

In the original manufacture of the cap into the form possessed by it before it is applied to a bottle, the two members may be held together by the mere force of friction at their telescoping junction. If however a more dependable or stronger junction is desired, this may be achieved by the provision of local radial deformations of the ring and of the upper end of the skirt member which penetrates telescopically into it. In a preferred embodiment of the cap of the invention, the skirt member rises inside the ring of the cap member to the line of incisions which defines the upper edge of that ring.

In accordance with another feature of the invention, the upper end of the skirt member possesses, as does that portion of the skirt of the cap member which is above the ring, a diameter equal to or slightly larger than the exterior diameter of the thread annulus of the bottle itself. The interior diameter of the ring portion of the cap member is desirably equal to the exterior diameter of the upper end of the skirt member.

BRIEF DESCRIPTION OF THE DRAWINGS

The invention will now be described in further detail and in terms of a number of presently preferred exemplary embodiments with reference to the accompanying drawings in which.

DESCRIPTION OF PREFERRED EMBODIMENTS

Figure 1:
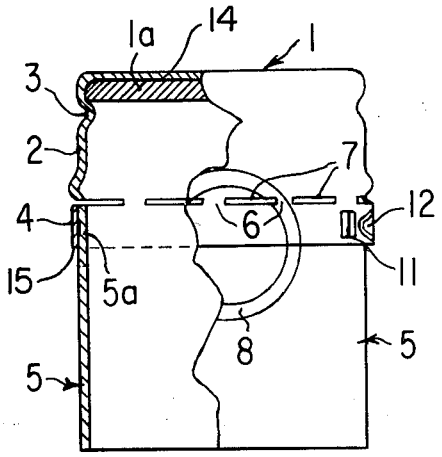
FIG. 1 is a view partially in elevation and partially in section of one form of bottle cap according to the invention before its application to a bottle.

In FIG. 1, the cap of the invention is seen to be of generally cylindrical form. It comprises two main parts, namely a cap member generally indicated at 1 and a skirt member generally indicated at 5. The cap member itself includes a crown 14 and a skirt 2 integrally connected thereto. A shallow constriction 3 may be formed in the skirt a short distance below the crown to retain against the inside of the crown a sealing wafer 1a whose function is to insure a liquid-tight or a liquid and gas-tight closure of the bottle when the cap is applied thereto.

The skirt 2 of the cap member is provided, a short distance above its lower end at 15, with a circular row of indentations, slits or perforations 7 separated from each other by bridge portions 6 which define the portion 4 of the skirt below those perforations as a detachable ring or tear strip.

In the cap as manufactured, and prior to its application to a bottle for closure thereof, the skirt member 5 may be of simple cylindrical shape as illustrated in FIG. 1. This member 5 fits, at an upper portion 5*a*, inside the ring 4 of the cap member 1. In order for example to facilitate handling of the cap prior to and during the bottling operation in which the cap is used initially to close a bottle, the members 1 and 5 are in the embodiment illustrated fastened together by means of a plurality of incisions 11 or indentations 12, or both, into the ring 4. These incisions and indentations effectively penetrate the upper end 5a of the skirt member 5 so that the members 1 and 5 are held together.

In FIG. 1 there is also shown an indicium 8, printed, stamped, embossed, or otherwise made visible on the cap, an extending in particular to the ring 4 and preferably also to the portion of the skirt 2 of the cap member above the ring 4, and also to the skirt member 5 below the ring 4. This indicium may for example constitute a tax stamp.

Figure 2:
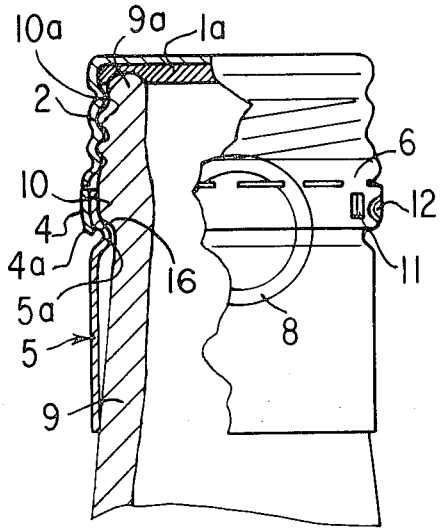
FIG. 2 is a view partially in elevation and partially in section of the cap of FIG. 1 as applied to a bottle and before initial opening of the bottle.

FIG. 2 shows the cap of FIG. 1 as applied to a bottle having a neck 9 and having a male thread 10*a* formed in the exterior surface of the upper end of that neck. The upper end of that neck extending from the rim 9*a* down to a shoulder 16 may be thickened and may be described as a thread annulus of the bottle. The cap, and in particular the ring 4 and the skirt member 5 are crimped beneath and against the shoulder 16 in the capping operation to insure tight closure of the bottle until the ultimate consumer opens it.

The bottle closing operation comprises the step of slipping the cap, as shown in FIG. 1, over the neck of the bottle, the step of pushing it down to compress the sealing wafer 1*a* against the rim 9*a* of the bottle as indicated in FIG. 2, the step of crimping the tear strip 4 at 4*a* and the skirt member 5 at 5*a* against and under the shoulder 16 as also shown in FIG. 2, and the step of forming a female thread in the upper, initially, approximately cylindrical portion of the cap member by pressing it, as by the use of rubber rollers or the like, against the male thread 10*a* of the bottle neck.

Because the ring 4 is crimped beneath the shoulder 16 and because it is affixed to the skirt member 5 which is also so crimped, when the bottle is opened by unscrewing the cap member 1, the unscrewing operation ruptures the bridges 6 and thereby separates the ring 4 from the remainder of the cap member. At the same time the ring breaks into several parts by reason of the incisions 11 therein. The ring therefore falls away.

Figure 3:
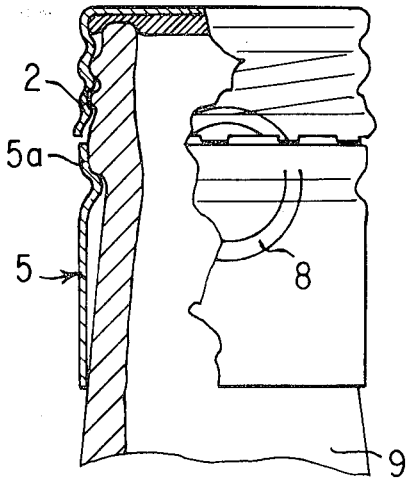
FIG. 3 is a view similar to FIG. 2 but showing the cap as employed to reclose the bottle after an initial opening thereof.

When the consumer recloses the bottle, by screwing back onto the neck the remainder of the cap member as illustrated in FIG. 3, the ring 4 will have disappeared and the indicium 8 will be incomplete. The fact that the bottle has been opened will thereby be unmistakably visible. As seen however in FIG. 3 that skirt member 5 still covers the neck of the bottle up to the lower edge of the cap member as it now exists. This fact may constitute an advantage from the point of view of the appearance of the reclosed bottle.

Alternatively the cap may be manufactured with an indicium on the exterior surface of the upper part 5*a* of the skirt member which is concealed until the bottle is first opened and which then becomes and remains visible even when the bottle is reclosed as in FIG. 3, due to the disappearance of the ring 4.

Figure 4:
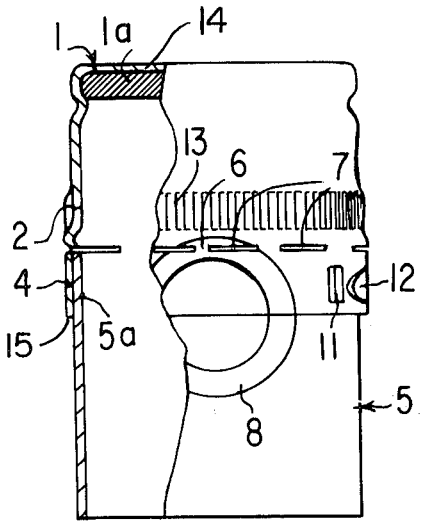
FIGS. 4 to 6 are view similar to those of FIGS. 1 to 3 respectively, but showing a cap according to the invention applied to a bottle whose thread annulus is of standard large height, the thread annulus in the bottle of FIGS. 2 and 3 being of less than standard height.
Figure 5:
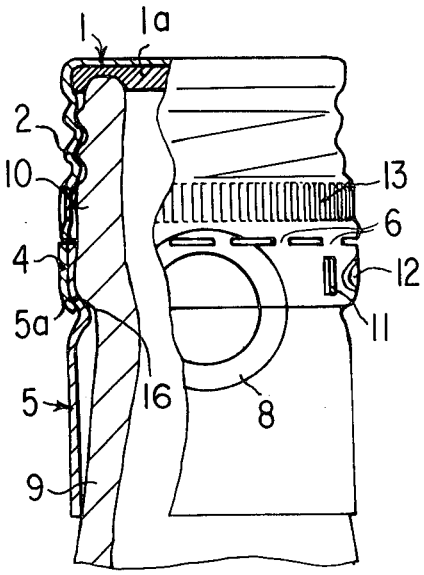
Figure 6:
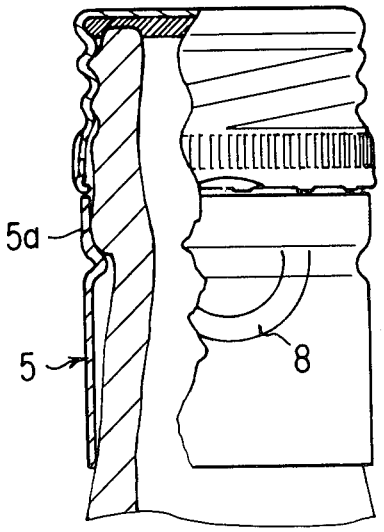

FIGS. 4 to 6 show that the cap of the invention may be manufactured for and used on bottles having a smooth cylindrical or substantially cylindrical surface of standard, large height above the crimping shoulder 16 and below the thread 10*a*. In such an embodiment, thus having a thread annulus of standard height, the cap member may be provided with knurlings, as indicated at 13 in FIGS. 4 and 5, above the ring 4 but below the portion of the cap member into which the female thread is to be formed in the course of the capping operation. These knurlings facilitate unscrewing and screwing of the cap from and onto the bottle. The mode of use of the embodiment of FIGS. 4 to 6 may in other respects be the same as that of FIGS. 1 to 3.

Since the crimping of the cap involves both the ring 4 of the cap member and the skirt member 5, it may be advantageous to make the cap member and/or skirt member thinner at the portions thereof so crimped.

While the invention has been described hereinabove in terms of a number of presently preferred embodiments thereof, the invention itself is not limited thereto but rather comprehends all modifications of and departures from those embodiments properly falling within the spirit and scope of the appended claims.

I claim:

1. A cap for a bottle having a thread-bearing annulus, said cap comprising a cap member and a skirt member, the cap member having a crown and a skirt integrally connected to the crown, said skirt further having a substantially circular row of perforations formed therein, said row defining as a removable ring the portion of the skirt below said row, said skirt further having therein a slit extending over part of the height of said ring, said skirt member being of cylindrical shape and extending at one end in telescoping relation inside of and being affixed to said ring, the opposite end of the skirt member extending below said ring.

2. A cap according to claim 1 wherein said members are affixed together by friction between the inner surface of said ring and the outer surface of said skirt member.

3. A cap according to claim 1 wherein said ring and the upper portion of said skirt member possess complementary protrusions and indentations respectively for affixation thereof together.

4. A cap according to claim 1 wherein the upper limit of said skirt member is substantially at the location of said perforations axially of said cap member.

5. A cap according to claim 1 in which the inside diameter of said skirt member is at least as large as the outside diameter of the thread-bearing annulus of the bottle to be capped thereby.

6. A cap according to claim 1 including visible indicia on the exterior surface of said ring.

7. A cap according to claim 6 wherein said indicia extend from said ring over a portion of the exterior surface of said skirt member below said ring.

* * * * *